US012800176B2

(12) United States Patent
Yang et al.

(10) Patent No.: US 12,800,176 B2
(45) Date of Patent: Nov. 17, 2026

(54) MULTI-SPLIT CENTRAL AIR CONDITIONING SYSTEM FOR SIMULTANEOUS COOLING AND HEATING

(71) Applicant: JINGKELUN REFRIGERATION EQUIPMENT CO., LTD., Beijing (CN)

(72) Inventors: Jianguo Yang, Beijing (CN); Chengjun Zhou, Beijing (CN); Jianhui Kang, Beijing (CN); Quanjiang Wang, Beijing (CN); Weibo Xie, Beijing (CN); Jilong Zhang, Beijing (CN)

(73) Assignee: JINGKELUN REFRIGERATION EQUIPMENT CO., LTD., Beijing (CN)

( * ) Notice: Subject to any disclaimer, the term of this patent is extended or adjusted under 35 U.S.C. 154(b) by 359 days.

(21) Appl. No.: 18/687,800

(22) PCT Filed: Oct. 28, 2022

(86) PCT No.: PCT/CN2022/128154
§ 371 (c)(1),
(2) Date: Feb. 28, 2024

(87) PCT Pub. No.: WO2023/088066
PCT Pub. Date: May 25, 2023

(65) Prior Publication Data

US 2026/0118009 A1 Apr. 30, 2026

(30) Foreign Application Priority Data

Nov. 17, 2021 (CN) ..... 202111361573.3

(51) Int. Cl.
*F24F 11/79* (2018.01)
*F25B 9/00* (2006.01)
*F25B 29/00* (2006.01)

(52) U.S. Cl.
CPC ..... *F24F 11/79* (2018.01); *F25B 9/008* (2013.01); *F25B 29/00* (2013.01); *F25B 29/003* (2013.01)

(58) Field of Classification Search
CPC ..... F24F 11/79; F25B 29/003; F25B 29/00; F25B 9/008
See application file for complete search history.

(56) References Cited

U.S. PATENT DOCUMENTS 7,254,955 B2 * 8/2007 Otake ..... F25B 29/003 62/238.7
2013/0213077 A1 8/2013 Jin et al.
2023/0057478 A1 2/2023 Iyoshi et al.

FOREIGN PATENT DOCUMENTS

CN 200943972 Y 9/2007
CN 200979258 Y 11/2007
(Continued)

OTHER PUBLICATIONS

European Patent Office, partial supplementary European search report issued in patent application No. 22894603.4 on Jun. 2, 2025.
(Continued)

*Primary Examiner* — William C Doerrler
(74) *Attorney, Agent, or Firm* — Kilpatrick Townsend & Stockton LLP

(57) ABSTRACT

The present disclosure relates to a multi-split central air conditioning system for simultaneous cooling and heating, including a condensation module, multiple indoor fan coil units, a high-pressure circulation tube, a medium-pressure circulation tube, a low-pressure circulation tube, and an evaporation module. The indoor fan coil units are connected to the high-pressure circulation tube by means of a first branch tube, to the low-pressure circulation tube by means of a second branch tube, and to the medium-pressure circulation tube by means of a third branch tube, and a solenoid
(Continued)

valve is provided on each of the first branch tube and the second branch tube. The beneficial effects are: when heating a local area in the summer and cooling a local room in the winter, refrigerant is circulated by means of solenoid valve switching and a medium-pressure circulation tube and the multi-split central air conditioning system has multiple working modes.

20 Claims, 2 Drawing Sheets

(56) References Cited

FOREIGN PATENT DOCUMENTS

| | | | | |
|---|---|---|---|---|
| CN | 101769580 | A | 7/2010 | |
| CN | 101865555 | A | 10/2010 | |
| CN | 102767876 | A | 11/2012 | |
| CN | 203908095 | U | 10/2014 | |
| CN | 104197570 | A | 12/2014 | |
| CN | 104913424 | A | 9/2015 | |
| CN | 110243083 | A | 9/2019 | |
| CN | 111520814 | A | 8/2020 | |
| CN | 113108428 | A | 7/2021 | |
| CN | 214469009 | U | 10/2021 | |
| CN | 113983586 | A | 1/2022 | |
| JP | H11334355 | A | 12/1999 | |
| WO | WO-2021048898 | A1 * | 3/2021 | ..... F25B 41/39 |
| WO | 2021225177 | A1 | 11/2021 | |

OTHER PUBLICATIONS

ISA State Intellectual Property Office of the People's Republic of China, International Search Report Issued in Application No. PCT/CN2022/128154, Jan. 19, 2023, WIPO, 11 pages.

The extended European search report received in the counterpart European Application 22894603.4, mailed on Sep. 17, 2025.

* cited by examiner

MULTI-SPLIT CENTRAL AIR CONDITIONING SYSTEM FOR SIMULTANEOUS COOLING AND HEATING

CROSS-REFERENCE TO RELATED APPLICATION

This application is a National Phase entry of PCT Application No. PCT/CN2022/128154, filed on Oct. 28, 2022, which claims the priority of the Chinese Patent Application No. 202111361573.3, titled "MULTI-SPLIT CENTRAL AIR CONDITIONING SYSTEM FOR SIMULTANEOUS COOLING AND HEATING", filed on Nov. 17, 2021 with the China National Intellectual Property Administration, which are incorporated herein by reference in their entireties.

FIELD

The present application relates to the field of air conditioning, and in particular to a multi-split central air conditioning system for simultaneously performing cooling and heating.

BACKGROUND

A refrigeration cycle is used by a central air conditioning to cool or heat an indoor space. The central air conditioning only performs cooling in summer and only performs heating in winter, which is the basic function of air conditioning. However, it also brings a problem that all air conditioners are in cooling mode if cooling is turned on, and all air conditioners are in heating mode if heating is turned on. In a transitional season, such as in southern China where the weather is sometimes cold and sometimes hot, different groups of people have different needs for temperature comfort. For example, middle-aged and young people with good physique may feel a bit hot and need to turn on the air conditioner for cooling, while the olds and kids may feel cold and need to turn on the air conditioner for heating. At present, most ordinary multi-split units on the market can only achieve a single cooling mode or heating mode. If it is necessary to achieve the requirements of simultaneously performing cooling and heating in different rooms under a same system, two separate air conditioning systems need to be mounted, which increases the construction cost.

As energy shortages become increasingly apparent, China has proposed a future development strategy of country with dual carbon target. Energy conservation, environmental protection, and low-carbon may become the mainstream direction of today's social development, guiding the development direction of technology applications in various walks of life. In the future selection of refrigerants, $CO_2$ as a natural refrigerant has once again attracted the attention of technicians in refrigeration industry for its characteristics such as large pressure difference, low viscosity, stable chemical properties, and good thermophysical properties. In recent years, the market share of products related to $CO_2$ has gradually increased.

Therefore, providing an air conditioning system which can simultaneously perform cooling in an independent space and heating in another independent space with a convenient switching between cooling and heating is the creative motivation of the present application.

SUMMARY

One embodiment of the present application is to overcome the defects in prior arts, and an air conditioning system which can simultaneously perform cooling in an independent space and heating in another independent space is provided according to the present application; providing the multi-split central air conditioning system for simultaneously performing cooling and heating with a convenient switching between cooling and heating is the creative motivation of the present application.

The embodiment according to the present application are as follows.

A multi-split central air conditioning system for simultaneously performing cooling and heating includes a condensation module, multiple indoor fan coils, a high-pressure flow pipe, a medium-pressure flow pipe, a low-pressure flow pipe, and an evaporation module, and the condensation module includes a compressor, a condenser, and a liquid storage tank which are connected in a listed sequence, and the high-pressure flow pipe is connected with an exhaust end of the compressor; the medium-pressure flow pipe is connected with the liquid storage tank and the evaporation module; the low-pressure flow pipe is connected with a suction end of the compressor and the evaporation module; the multiple indoor fan coils are connected with the high-pressure flow pipe through a first branch pipe, connected with the low-pressure flow pipe through a second branch pipe, and connected with the medium-pressure flow pipe through a third branch pipe, and a first solenoid valve is provided on the first branch pipe, and a second solenoid valve is provided on the second branch pipe.

Further, an electronic expansion valve is provided on a third branch pipe.

Further, in a case that one part of the multiple indoor fan coils needs to perform cooling, the first solenoid valve of the indoor fan coils to perform cooling is closed, a refrigerant in the liquid storage tank flows through the medium-pressure flow pipe, the electronic expansion valve, the indoor fan coil, the second solenoid valve and the low-pressure flow pipe in a listed sequence to complete a refrigeration cycle.

In a case that another part of the multiple indoor fan coils needs to perform heating, the second solenoid valve of the indoor fan coils to perform heating is closed, a high-temperature refrigerant at the exhaust end of the compressor flows through the high-pressure flow pipe, the first solenoid valve, the indoor fan coil, the electronic expansion valve, the evaporation module and the low-pressure flow pipe in a listed sequence to complete a heating cycle.

Further, a temperature sensor and a pressure sensor are arranged at the exhaust end of the compressor, and a temperature sensor is arranged at the suction end of the compressor; a temperature sensor is provided on a pipeline between the condenser and the liquid storage tank; a solenoid valve and a capillary tube are provided on a pipeline between the liquid storage tank and the compressor; a temperature sensor is provided at each of an inlet end and an outlet end of each indoor fan coil; a pressure sensor is provided on each of the medium-pressure flow pipe and the low-pressure flow pipe.

Further, a first constant pressure valve is provided on a pipeline connecting the exhaust end of the compressor with the condenser of the condensation module, and a second constant pressure valve is provided on the pipeline between the condenser and the liquid storage tank.

Further, the air conditioning system further includes a floor heating pipe and/or a domestic hot water pipe.

The floor heating pipe is connected with the high-pressure flow pipe and the medium-pressure flow pipe, an electronic expansion valve is provided on a pipeline connecting the floor heating pipe with the medium-pressure flow pipe, and a manual check valve is provided on a pipeline connecting the floor heating pipe with the high-pressure flow pipe.

The domestic hot water pipe is connected with the high-pressure flow pipe and the medium-pressure flow pipe, an electronic expansion valve is provided on a pipeline connecting the domestic hot water pipe with the medium-pressure flow pipe, and a manual check valve is provided on a pipeline connecting the domestic hot water pipe with the high-pressure flow pipe.

Further, the evaporation module is a freeze-thaw circulation evaporator which includes an infrared heat collector, a heat collecting end, an energy tank and a heat exchanger, a freeze-thaw medium is stored in the energy tank, the heat collecting end and the heat exchanger are arranged in the energy tank, and each of two ends of the heat exchanger is connected with a refrigerant circulation pipeline.

Further, the medium-pressure flow pipe is connected with an infrared heat collecting plate, and a fourth control valve is provided between the medium-pressure flow pipe and the infrared heat collecting plate; the infrared heat collecting plate is connected with the heat collecting end, another end of the heat collecting end is connected to the low-pressure flow pipe; the high-pressure flow pipe is connected with a first control valve, the first control valve is connected with the heat exchanger and the second control valve, another end of the second control valve is connected to the low-pressure flow pipe, another end of the heat exchanger is connected with a third control valve, and the third control valve is connected with the medium-pressure flow pipe.

Further, the refrigerant is Freon, ammonia or carbon dioxide.

Further, the refrigerant is carbon dioxide as a single circulating working medium, the condenser is a flash evaporator which includes a closed housing, a negative pressure fan and multiple heat exchange units, the negative pressure fan is arranged at the top of the closed housing for forming a negative pressure in the closed housing; the multiple heat exchange units are arranged in the closed housing by stacking, the heat exchange units include a water atomizer, multiple rows of coils for flowing the refrigerant and fins for fixing the multiple rows of coils, the multiple rows of coils are fixed to the fins by a fixing frame, and carbon dioxide flows in from an inlet end and is discharged from an outlet end; the water atomizer is connected with a water source for atomizing water.

The implementation of the present application includes the following effects.

The entire central air conditioning system according to the present application removes heat by the condenser and absorbs heat by the infrared heat collector. During heating in local area in summer or refrigeration in local room in winter, flow of the refrigerant is achieved by switching of solenoid valves and the medium-pressure flow pipe. Therefore, the multi-split central air conditioning system according to the present application has multiple operating modes (separate cooling/separate heating/simultaneous partial cooling and partial heating), and the diversity of overall operation of the multi-split air conditioning system is improved without adding a complex refrigerant switching pipeline. The system according to the present application can simultaneously perform cooling and heating, which solves the different needs of different people for physical comfort. In one system, separate cooling and separate heating of different indoor units can be realized.

The condensation module and the evaporation module can further be used as balancers of the entire air conditioning system for balancing the operating pressure and other parameters during the operation of the air conditioning system, to ensure efficient and stable operation of the system, which is also an important effect of the present application.

Figure 1:
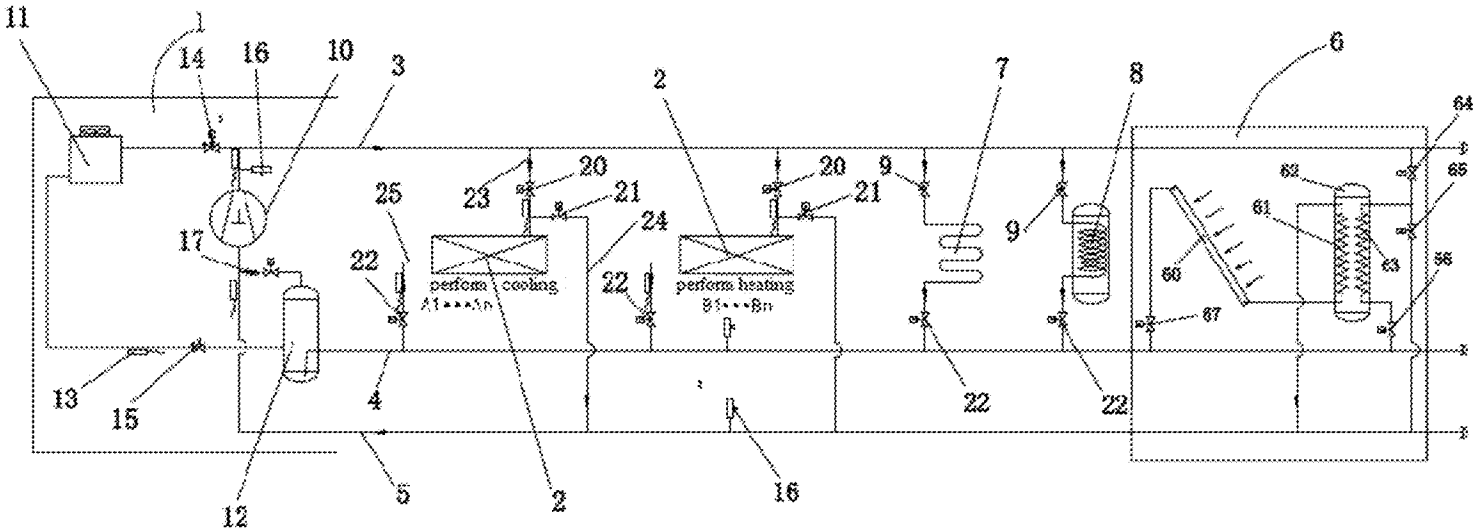
FIG. 1 is a schematic view of a multi-split central air conditioning system for simultaneously performing cooling and heating according to an embodiment of the present application.

Reference numerals in the drawings are listed as follows:

| | |
|---|---|
| 1, condensation module; | 10, compressor; |
| 11, condenser; | 110, closed housing; |
| 111, negative pressure fan; | 112, heat exchange unit; |
| 113, water atomizer; | 12, liquid storage tank; |
| 13, temperature sensor; | 14, first constant pressure valve; |
| 15, second constant pressure valve; | 16, pressure sensor; |
| 17, capillary tube; | 2, indoor fan coil; |
| 20, first solenoid valve; | 21, second solenoid valve; |
| 22, electronic expansion valve; | 23, first branch pipe; |
| 24, second control valve; | 25, third branch pipe; |
| 3, high-pressure flow pipe; | 4, medium-pressure flow pipe; |
| 5, low-pressure flow pipe; | 6, evaporation module; |
| 60, infrared heat collector; | 61, heat collecting end; |
| 62, energy tank; | 63, heat exchanger; |
| 64, first control valve; | 65, second control valve; |
| 66, third control valve; | 67, fourth control valve; |
| 7, floor heating pipe; | 8, domestic hot water pipe; |
| 9, manual check valve. | |

DETAILED DESCRIPTION OF EMBODIMENTS

The present application will be described in detail below with reference to the embodiments and the drawings. It should be noted that the described embodiments are only intended to facilitate the understanding of the present application and do not limit the present application.

Referring to FIG. 1, a multi-split central air conditioning system for simultaneously performing cooling and heating is provided in this embodiment, which includes a condensation module 1, multiple indoor fan coils 2, a high-pressure flow pipe 3, a medium-pressure flow pipe 4, a low-pressure flow pipe 5, and an evaporation module 6. The condensation module 1 includes a compressor 10, a condenser 11, and a liquid storage tank 12 which are connected in a listed sequence, and the high-pressure flow pipe 3 is connected with an exhaust end of the compressor 10 and the evaporation module 6 for flowing a high-temperature and high-pressure refrigerant discharged from the compressor 10. The medium-pressure flow pipe 4 is connected with the liquid storage tank 12 and the evaporation module 6 for flowing a medium-pressure refrigerant discharged from the multiple indoor fan coils 2. The low-pressure flow pipe 5 is connected with a suction end of the compressor 10 and the evaporation module 6 for flowing a low-pressure refrigerant. The indoor fan coil units 2 are connected with the high-pressure flow pipe 3 through a first branch pipe 23, connected with the low-pressure flow pipe 5 through a second branch pipe 24, and connected with the medium-pressure flow pipe 4 through a third branch pipe 25. A first solenoid valve 20 is provided on the first branch pipe 23, and a second solenoid valve 21 is provided on the second branch pipe 24, and an electronic expansion valve 22 is provided on the third branch 25.

Referring to FIG. 1, during the same time period, when the indoor fan coil 2 in A1 to An needs to perform cooling, and the indoor fan coil 2 in B1 to Bn needs to perform cooling, the first solenoid valve 20 of the indoor fan coil 2 in A1 to An is closed, the refrigerant in the liquid storage tank 12 flows through the medium-pressure flow pipe 4, the electronic expansion valve 22, the indoor fan coil 2, the second solenoid valve 21, the low-pressure flow pipe 5 in a listed sequence to complete the refrigeration cycle. At this time, the second solenoid valve 21 of the indoor fan coil 2 in B1 to Bn is closed, the high-temperature refrigerant at the exhaust end of the compressor 10 flows through the high-pressure flow pipe 3, the first solenoid valve 21, the indoor fan coil 2, the electronic expansion valve 22, the evaporation module 6 and the low-pressure flow pipe 5 in a listed sequence to complete the heating cycle.

The entire central air conditioning according to the present application removes heat by the condenser 11, and absorbs heat by the freeze-thaw circulation evaporator. During heating in local area in summer or cooling in local room in winter, flow of the refrigerant is achieved by switching of solenoid valves and the medium-pressure flow pipe. Therefore, the multi-split central air conditioning system of the present application has multiple operating modes (separate cooling/separate heating/simultaneous partial cooling and partial heating), and the diversity of overall operation of the multi-split air conditioning system is improved without adding a complex refrigerant switching pipeline. The system according to the present application can simultaneously perform cooling and heating, which solves the different needs of different people for physical comfort. In one system, separate cooling and separate heating of different indoor units can be realized.

Referring to FIG. 1, a first constant pressure valve 14 is provided on a pipeline connecting the exhaust end of the compressor 10 with the condenser 11 of the condensation module 1. The constant pressure valve between the compressor 10 and the flash evaporator works in winter, to keep an exhaust pressure constant at a pressure corresponding to a maximum COP. In summer, the constant pressure valve is fully opened for pipeline protection. A second constant pressure valve 15 is provided on a pipeline between the condenser 11 and the liquid storage tank 12. The constant valve between the flash evaporator and the liquid storage tank 12 keeps a pressure of the liquid storage tank 12 constant within a certain range, such as from 60 to 65 bar. A temperature sensor 13 and a pressure sensor 16 are arranged at the exhaust end of the compressor 10, and a temperature sensor 13 is arranged at the suction end of the compressor 10. A temperature sensor 13 is provided on the pipeline between the condenser 11 and the liquid storage tank 12. A solenoid valve and a capillary tube 17 are provided on a pipeline between the liquid storage tank 12 and the compressor 10. A temperature sensor 13 is provided at each of an inlet end and an outlet end of each indoor fan coil 2. A pressure sensor 16 is provided on each of the medium-pressure flow pipe 4 and the low-pressure flow pipe 5. The capillary tube 17 has the function of throttling and depressurizing, to avoid excessive evaporation of liquid refrigerant in the liquid storage tank 12. The temperature data and pressure data of each key node are collected by the temperature sensors 13 and the pressure sensors 16, which are used as the basis for controlling the opening degree of the compressor, the fan, the solenoid valve and the electronic expansion valve, to improve the operating efficiency of the system.

Referring to FIG. 1, the central air conditioning further includes a floor heating pipe 7 which is connected with the high-pressure flow pipe 3 and the medium-pressure flow pipe 4, an electronic expansion valve 22 is provided on a pipeline connecting the floor heating pipe 7 with the medium-pressure flow pipe 4, and a manual check valve 9 is provided on a pipeline connecting the floor heating pipe 7 with the high-pressure flow pipe 3. The central air conditioning further includes a domestic hot water pipe 8 which is connected with the high-pressure flow pipe 3 and the medium-pressure flow pipe 4, an electronic expansion valve 22 is provided on a pipeline connecting the domestic hot water pipe 8 with the medium-pressure flow pipe 4, and a manual check valve 9 is provided on a pipeline connecting the domestic hot water pipe 8 with the high-pressure flow pipe 3. In a case that the floor heating is needed or the domestic hot water needs to be supplied, the manual check valve 9 is opened, the high-temperature refrigerant at the exhaust end of the compressor 10 flows through the high-pressure flow pipe 3, the manual check valve 9, the floor heating pipe 7/the domestic hot water pipe 8, the electronic expansion valve 22, the evaporation module 6, and the low-pressure flow pipe 5 in a listed sequence to complete the heating cycle.

Embodiment of the present disclosure, referring to FIG. 1, the evaporation module is a freeze-thaw circulation evaporator which includes an infrared heat collector 60, a heat collecting end 61, an energy tank 62 and a heat exchanger 63, a freeze-thaw medium is stored in the energy tank 62, the heat collecting end 61 and the heat exchanger 63 are arranged in the energy tank 62, and each of two ends of the heat exchanger 63 is connected with a refrigerant circulation pipeline. The low-temperature refrigerant exchanges heat with the freeze-thaw medium after flowing through the heat exchanger 63. The infrared heat collector 60 stores the absorbed solar energy in the energy tank 62 and extracts the heat from the freeze-thaw medium as needed. The freeze-thaw medium is a phase change energy storage material, for example, the freeze-thaw medium is water. The transformation of water at 0° C. into ice at 0° C. requires a large amount of heat to be released. Water is an inexpensive and environmentally friendly substance, which further reduces costs.

In one embodiment, the medium-pressure flow pipe 4 is connected with an infrared heat collecting plate 60, and a fourth control valve 67 is provided between the medium-pressure flow pipe 4 and the infrared heat collecting plate 60. The infrared heat collecting plate 60 is connected with the heat collecting end 61, another end of the heat collecting end 61 is connected to the low-pressure flow pipe 5. The high-pressure flow pipe 3 is connected with a first control valve 64, the first control valve 64 is connected with the heat exchanger 63 and the second control valve 65, another end of the second control valve 65 is connected to the low-pressure flow pipe 5, another end of the heat exchanger 63 is connected with a third control valve 66, and the third control valve 66 is connected with the medium-pressure flow pipe 4.

In the case of heating mode as the main mode: at night, the second control valve 65, the third control valve 66, and the fourth control valve 67 are opened first, and the first control valve 64 is closed. The heat stored in the energy tank 62 during the day is extracted by the cooling mode for room heating. When the medium in the energy tank 62 reaches the phase change temperature, the first control valve 64 is opened, the second control valve 65 is closed, and the third control valve 66 and the fourth control valve 67 remain open, and the heat of the high-temperature exhaust is transferred to the suction end through the medium in the energy tank 62, to maintain stable operation of the system. During the day, the first control valve 64, the second control valve 65, and the third control valve 66 are closed, and the fourth control valve 67 is opened first. The low-temperature medium in the tank is heated by the overheated return air through the energy tank 62. If a temperature of the return air is higher than a set value, the second control valve 65 and the third control valve 66 are opened to cool the return air.

According to the present application, light energy and air energy are stored in the energy tank 62 in a phase-change form through a phase-change energy storage material. Solar energy can be used for heating when the sunshine is sufficient, which is green and environmentally friendly. The heat collector can also collect some heat through thermal radiation when the sunshine is insufficient, and heat can be collected by an air energy collector, to ensure the heating demand.

The refrigerant may be Freon, ammonia, carbon dioxide and other medium, in this embodiment, carbon dioxide medium may be used as the refrigeration working medium of the central air conditioner. As a circulating working medium, carbon dioxide has the advantages of large pressure difference, good fluidity, low density and transcritical phase change, and the effect is more apparent when carbon dioxide is used in high-rise buildings. The refrigerant circulating pipeline is connected to a single-stage carbon dioxide circulation system using carbon dioxide as a single circulating working medium. The meaning of single stage is different from cascade system, which only uses carbon dioxide medium for circulation, and cascade is not required. The multi-split central air conditioning system in this embodiment with carbon dioxide as the working medium can provide cooling or heating for higher floors at vertical height, and can circulate a longer distance in the plane floors, and can drive more indoor units to work.

Figure 2:
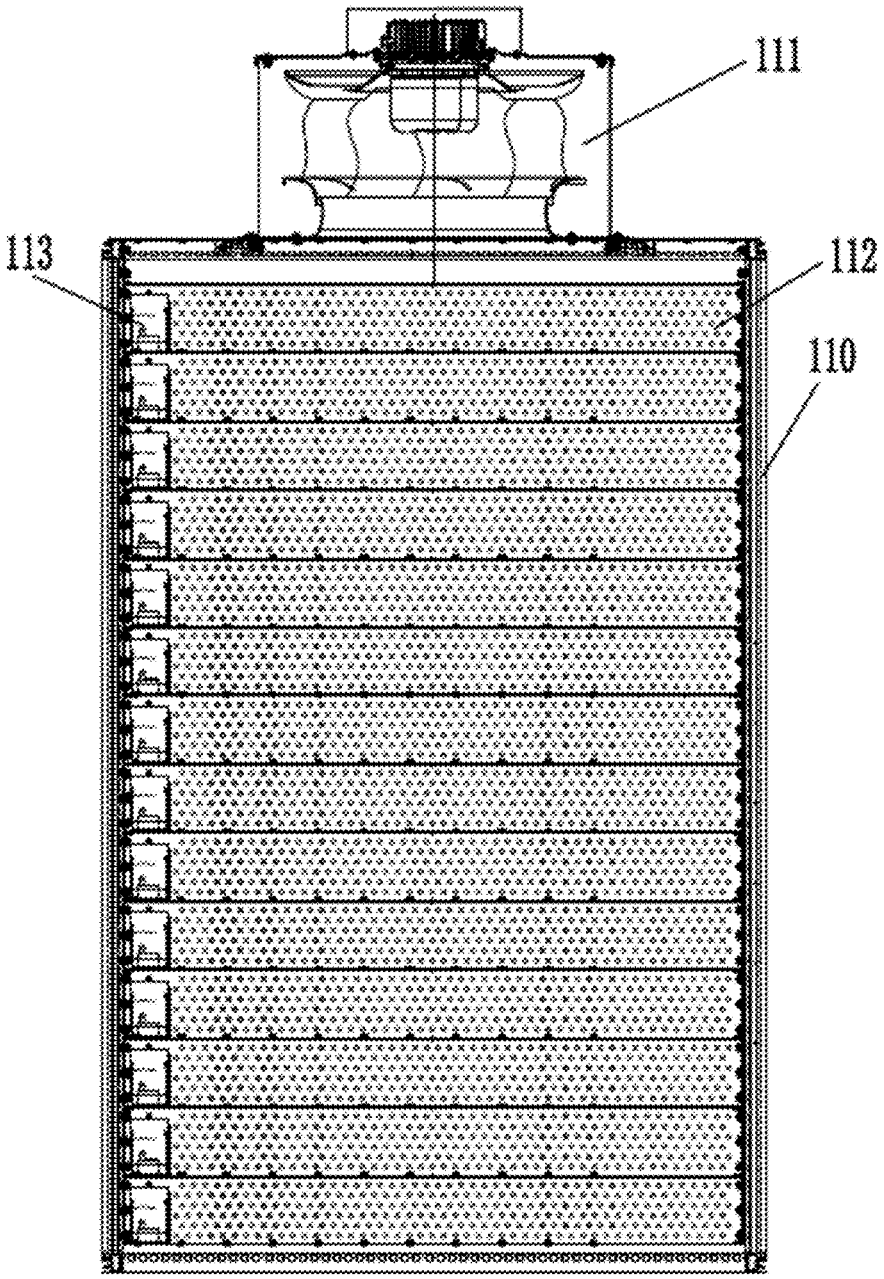
FIG. 2 is a schematic structural view of a flash evaporator.

When carbon dioxide is selected as the refrigerant, referring to FIG. 2, the condenser 11 may be a flash evaporator which includes a closed housing 110, a negative pressure fan 111 and multiple heat exchange units 112, the negative pressure fan 111 is arranged at the top of the closed housing 110 for forming a negative pressure in the closed housing 110. The multiple heat exchange units 112 are arranged in the closed housing 110 by stacking. The heat exchange units 112 include a water atomizer 113, multiple rows of coils for flowing the refrigerant and fins for fixing the multiple rows of coils, the multiple rows of coils are fixed to the fins by a fixing frame, and carbon dioxide flows in from an inlet end and is discharged from an outlet end. The multiple rows of coils of multiple heat exchange units 112 are connected in series. The water atomizer 113 is connected with a water source for atomizing water. The atomized water diffuses into an inner cavity of the closed housing 110, and liquid micro micelles exchanges heat with the carbon dioxide in the multiple rows of coils complete radiation heat transfer by thermal radiation and is extracted from the closed housing 110 by the negative pressure fan 111 under the negative pressure. During refrigeration, the water micelles in the cavity absorb the radiant heat of carbon dioxide circulating in the multiple rows of coils and then the water micelles are gradually decomposed into small micelles, to take away the heat and condense and liquefy the carbon dioxide refrigerant. Water micelles are dynamically and continuously decomposed into small water micelles, which take away heat. Ultrasonic atomizing water itself has the function of descaling to avoid scaling on the surfaces of heat exchange pipes and fins. The water vapor after heat exchange is not recycled, and is discharged directly into the atmosphere. Since heat is mainly converted into internal energy in the process of water micelle decomposition, the temperature of discharged water vapor is not high, and the heat island effect may not occur. The multiple heat exchange units 112 are stacked, which facilitates mounting and maintenance. In a case that a certain heat exchange unit 112 is broken, the broken heat exchange unit can be removed for maintenance or replacement. Compared with the existing air-cooled heat exchanger, the flash evaporator exchanges heat in the closed housing 110 with almost no air intake. When the external temperature and humidity are high, the heat exchange effect is not affected by the temperature and humidity of the external natural wind.

Finally, it should be noted that, the above embodiments are only used for illustration of the embodiments of the present application rather than limitation to the protection scope of the present application. Although the present application has been illustrated in detail with reference to the embodiments, and modifications or equivalent replacements may be made to the embodiments of the present application without departing from the essence and scope of the present application.

The invention claimed is:

1. A multi-split central air conditioning system for simultaneously performing cooling and heating, comprising a condensation module, a plurality of indoor fan coils, a high-pressure flow pipe, a medium-pressure flow pipe, a low-pressure flow pipe, and an evaporation module, wherein the condensation module comprises a compressor, a condenser, and a liquid storage tank which are connected in a listed sequence, and the high-pressure flow pipe is connected with an exhaust end of the compressor; the medium-pressure flow pipe is connected with the liquid storage tank and the evaporation module; the low-pressure flow pipe is connected with a suction end of the compressor and the evaporation module; the plurality of indoor fan coils are connected with the high-pressure flow pipe through a first branch pipe, connected with the low-pressure flow pipe through a second branch pipe, and connected with the medium-pressure flow pipe through a third branch pipe, wherein a first solenoid valve is provided on the first branch pipe, and a second solenoid valve is provided on the second branch pipe;

a temperature sensor and a pressure sensor are arranged at the exhaust end of the compressor, and a temperature sensor is arranged at the suction end of the compressor; a temperature sensor is provided on a pipeline between the condenser and the liquid storage tank; a solenoid valve and a capillary tube are provided on a pipeline between the liquid storage tank and the compressor; a temperature sensor is provided at each of an inlet end and an outlet end of each indoor fan coil; a pressure sensor is provided on each of the medium-pressure flow pipe and the low-pressure flow pipe; and a first constant pressure valve is provided on a pipeline connecting the exhaust end of the compressor with the condenser of the condensation module, and a second constant pressure valve is provided on the pipeline between the condenser and the liquid storage tank.

2. The multi-split central air conditioning system for simultaneously performing cooling and heating according to claim 1, wherein an electronic expansion valve is provided on the third branch pipe, and in a case that an indoor fan coil needs to perform cooling, the first solenoid valve of the indoor fan coil to perform cooling is closed, a refrigerant in the liquid storage tank flows through the medium-pressure flow pipe, the electronic expansion valve, the indoor fan coil, the second solenoid valve and the low-pressure flow pipe in a listed sequence to complete a refrigeration cycle; and in a case that another indoor fan coil needs to perform heating, the second solenoid valve of the indoor fan coil to perform heating is closed, a high-temperature refrigerant at the exhaust end of the compressor flows through the high-pressure flow pipe, the first solenoid valve, the indoor fan coil, the electronic expansion valve, the evaporation module and the low-pressure flow pipe in a listed sequence to complete a heating cycle.

3. The multi-split central air conditioning system for simultaneously performing cooling and heating according to claim 1, wherein the air conditioning system further comprises a floor heating pipe and/or a domestic hot water pipe;

the floor heating pipe is connected with the high-pressure flow pipe and the medium-pressure flow pipe, an electronic expansion valve is provided on a pipeline connecting the floor heating pipe with the medium-pressure flow pipe, and a manual check valve is provided on a pipeline connecting the floor heating pipe with the high-pressure flow pipe;

the domestic hot water pipe is connected with the high-pressure flow pipe and the medium-pressure flow pipe, an electronic expansion valve is provided on a pipeline connecting the domestic hot water pipe with the medium-pressure flow pipe, and a manual check valve is provided on a pipeline connecting the domestic hot water pipe with the high-pressure flow pipe.

4. The multi-split central air conditioning system for simultaneously performing cooling and heating according to claim 1, wherein the evaporation module is a freeze-thaw circulation evaporator which comprises an infrared heat collector, a heat collecting end, an energy tank and a heat exchanger, a freeze-thaw medium is stored in the energy tank, the heat collecting end and the heat exchanger are arranged in the energy tank, and each of two ends of the heat exchanger is connected with a refrigerant circulation pipeline.

5. The multi-split central air conditioning system for simultaneously performing cooling and heating according to claim 4, wherein the medium-pressure flow pipe is connected with an infrared heat collecting plate, and a fourth control valve is provided between the medium-pressure flow pipe and the infrared heat collecting plate; the infrared heat collecting plate is connected with the heat collecting end, another end of the heat collecting end is connected to the low-pressure flow pipe; the high-pressure flow pipe is connected with a first control valve, the first control valve is connected with the heat exchanger and a second control valve, another end of the second control valve is connected to the low-pressure flow pipe, another end of the heat exchanger is connected with a third control valve, and the third control valve is connected with the medium-pressure flow pipe.

6. The multi-split central air conditioning system for simultaneously performing cooling and heating according to claim 1, wherein the refrigerant is Freon, ammonia or carbon dioxide.

7. The multi-split central air conditioning system for simultaneously performing cooling and heating according to claim 1, wherein the refrigerant is carbon dioxide as a single circulating working medium, the condenser is a flash evaporator which comprises a closed housing, a negative pressure fan and a plurality of heat exchange units, the negative pressure fan is arranged at the top of the closed housing for forming a negative pressure in the closed housing; the plurality of heat exchange units are arranged in the closed housing by stacking, the heat exchange units comprise a water atomizer, a plurality of rows of coils for flowing the refrigerant and fins for fixing the plurality of rows of coils, the plurality of rows of coils are fixed to the fins by a fixing frame, and carbon dioxide flows in from an inlet end and is discharged from an outlet end; the water atomizer is connected with a water source for atomizing water.

8. A multi-split central air conditioning system for simultaneously performing cooling and heating, comprising a condensation module, a plurality of indoor fan coils, a high-pressure flow pipe, a medium-pressure flow pipe, a low-pressure flow pipe, and an evaporation module, wherein the condensation module comprises a compressor, a condenser, and a liquid storage tank which are connected in a listed sequence, and the high-pressure flow pipe is connected with an exhaust end of the compressor; the medium-pressure flow pipe is connected with the liquid storage tank and the evaporation module; the low-pressure flow pipe is connected with a suction end of the compressor and the evaporation module; the plurality of indoor fan coils are connected with the high-pressure flow pipe through a first branch pipe, connected with the low-pressure flow pipe through a second branch pipe, and connected with the medium-pressure flow pipe through a third branch pipe, wherein a first solenoid valve is provided on the first branch pipe, and a second solenoid valve is provided on the second branch pipe;

the air conditioning system further comprises a floor heating pipe and/or a domestic hot water pipe;

the floor heating pipe is connected with the high-pressure flow pipe and the medium-pressure flow pipe, an electronic expansion valve is provided on a pipeline connecting the floor heating pipe with the medium-pressure flow pipe, and a manual check valve is provided on a pipeline connecting the floor heating pipe with the high-pressure flow pipe;

the domestic hot water pipe is connected with the high-pressure flow pipe and the medium-pressure flow pipe, an electronic expansion valve is provided on a pipeline connecting the domestic hot water pipe with the medium-pressure flow pipe, and a manual check valve is provided on a pipeline connecting the domestic hot water pipe with the high-pressure flow pipe.

9. The multi-split central air conditioning system for simultaneously performing cooling and heating according to claim 8, wherein an electronic expansion valve is provided on the third branch pipe, and in a case that an indoor fan coil needs to perform cooling, the first solenoid valve of the indoor fan coil to perform cooling is closed, a refrigerant in the liquid storage tank flows through the medium-pressure flow pipe, the electronic expansion valve provided on the third branch pipe, the indoor fan coil, the second solenoid valve and the low-pressure flow pipe in a listed sequence to complete a refrigeration cycle; and in a case that another indoor fan coil needs to perform heating, the second solenoid valve of the indoor fan coil to perform heating is closed, a high-temperature refrigerant at the exhaust end of the compressor flows through the high-pressure flow pipe, the first solenoid valve, the indoor fan coil, the electronic expansion valve provided on the third branch pipe, the evaporation module and the low-pressure flow pipe in a listed sequence to complete a heating cycle.

10. The multi-split central air conditioning system for simultaneously performing cooling and heating according to claim 8, wherein a temperature sensor and a pressure sensor are arranged at the exhaust end of the compressor, and a temperature sensor is arranged at the suction end of the compressor; a temperature sensor is provided on a pipeline between the condenser and the liquid storage tank; a solenoid valve and a capillary tube are provided on a pipeline between the liquid storage tank and the compressor; a temperature sensor is provided at each of an inlet end and an outlet end of each indoor fan coil; a pressure sensor is provided on each of the medium-pressure flow pipe and the low-pressure flow pipe.

11. The multi-split central air conditioning system for simultaneously performing cooling and heating according to claim 8, wherein the evaporation module is a freeze-thaw circulation evaporator which comprises an infrared heat collector, a heat collecting end, an energy tank and a heat exchanger, a freeze-thaw medium is stored in the energy tank, the heat collecting end and the heat exchanger are arranged in the energy tank, and each of two ends of the heat exchanger is connected with a refrigerant circulation pipeline.

12. The multi-split central air conditioning system for simultaneously performing cooling and heating according to claim 11, wherein the medium-pressure flow pipe is connected with an infrared heat collecting plate, and a fourth control valve is provided between the medium-pressure flow pipe and the infrared heat collecting plate; the infrared heat collecting plate is connected with the heat collecting end, another end of the heat collecting end is connected to the low-pressure flow pipe; the high-pressure flow pipe is connected with a first control valve, the first control valve is connected with the heat exchanger and a second control valve, another end of the second control valve is connected to the low-pressure flow pipe, another end of the heat exchanger is connected with a third control valve, and the third control valve is connected with the medium-pressure flow pipe.

13. The multi-split central air conditioning system for simultaneously performing cooling and heating according to claim 8, wherein the refrigerant is Freon, ammonia or carbon dioxide.

14. The multi-split central air conditioning system for simultaneously performing cooling and heating according to claim 8, wherein the refrigerant is carbon dioxide as a single circulating working medium, the condenser is a flash evaporator which comprises a closed housing, a negative pressure fan and a plurality of heat exchange units, the negative pressure fan is arranged at the top of the closed housing for forming a negative pressure in the closed housing; the plurality of heat exchange units are arranged in the closed housing by stacking, the heat exchange units comprise a water atomizer, a plurality of rows of coils for flowing the refrigerant and fins for fixing the plurality of rows of coils, the plurality of rows of coils are fixed to the fins by a fixing frame, and carbon dioxide flows in from an inlet end and is discharged from an outlet end; the water atomizer is connected with a water source for atomizing water.

15. A multi-split central air conditioning system for simultaneously performing cooling and heating, comprising a condensation module, a plurality of indoor fan coils, a high-pressure flow pipe, a medium-pressure flow pipe, a low-pressure flow pipe, and an evaporation module, wherein the condensation module comprises a compressor, a condenser, and a liquid storage tank which are connected in a listed sequence, and the high-pressure flow pipe is connected with an exhaust end of the compressor; the medium-pressure flow pipe is connected with the liquid storage tank and the evaporation module; the low-pressure flow pipe is connected with a suction end of the compressor and the evaporation module; the plurality of indoor fan coils are connected with the high-pressure flow pipe through a first branch pipe, connected with the low-pressure flow pipe through a second branch pipe, and connected with the medium-pressure flow pipe through a third branch pipe, wherein a first solenoid valve is provided on the first branch pipe, and a second solenoid valve is provided on the second branch pipe; and the evaporation module is a freeze-thaw circulation evaporator which comprises an infrared heat collector, a heat collecting end, an energy tank and a heat exchanger, a freeze-thaw medium is stored in the energy tank, the heat collecting end and the heat exchanger are arranged in the energy tank, and each of two ends of the heat exchanger is connected with a refrigerant circulation pipeline.

16. The multi-split central air conditioning system for simultaneously performing cooling and heating according to claim 15, wherein an electronic expansion valve is provided on the third branch pipe, and in a case that an indoor fan coil needs to perform cooling, the first solenoid valve of the indoor fan coil to perform cooling is closed, a refrigerant in the liquid storage tank flows through the medium-pressure flow pipe, the electronic expansion valve, the indoor fan coil, the second solenoid valve and the low-pressure flow pipe in a listed sequence to complete a refrigeration cycle; and in a case that another indoor fan coil needs to perform heating, the second solenoid valve of the indoor fan coil to perform heating is closed, a high-temperature refrigerant at the exhaust end of the compressor flows through the high-pressure flow pipe, the first solenoid valve, the indoor fan coil, the electronic expansion valve, the evaporation module and the low-pressure flow pipe in a listed sequence to complete a heating cycle.

17. The multi-split central air conditioning system for simultaneously performing cooling and heating according to claim 15, wherein a temperature sensor and a pressure sensor are arranged at the exhaust end of the compressor, and a temperature sensor is arranged at the suction end of the compressor; a temperature sensor is provided on a pipeline between the condenser and the liquid storage tank; a solenoid valve and a capillary tube are provided on a pipeline between the liquid storage tank and the compressor; a temperature sensor is provided at each of an inlet end and an outlet end of each indoor fan coil; a pressure sensor is provided on each of the medium-pressure flow pipe and the low-pressure flow pipe.

18. The multi-split central air conditioning system for simultaneously performing cooling and heating according to claim 15, wherein the medium-pressure flow pipe is connected with an infrared heat collecting plate, and a fourth control valve is provided between the medium-pressure flow pipe and the infrared heat collecting plate; the infrared heat collecting plate is connected with the heat collecting end, another end of the heat collecting end is connected to the low-pressure flow pipe; the high-pressure flow pipe is connected with a first control valve, the first control valve is connected with the heat exchanger and a second control valve, another end of the second control valve is connected to the low-pressure flow pipe, another end of the heat exchanger is connected with a third control valve, and the third control valve is connected with the medium-pressure flow pipe.

19. The multi-split central air conditioning system for simultaneously performing cooling and heating according to claim 15, wherein the refrigerant is Freon, ammonia or carbon dioxide.

20. The multi-split central air conditioning system for simultaneously performing cooling and heating according to claim 15, wherein the refrigerant is carbon dioxide as a single circulating working medium, the condenser is a flash evaporator which comprises a closed housing, a negative pressure fan and a plurality of heat exchange units, the negative pressure fan is arranged at the top of the closed housing for forming a negative pressure in the closed housing; the plurality of heat exchange units are arranged in the closed housing by stacking, the heat exchange units comprise a water atomizer, a plurality of rows of coils for flowing the refrigerant and fins for fixing the plurality of rows of coils, the plurality of rows of coils are fixed to the fins by a fixing frame, and carbon dioxide flows in from an inlet end and is discharged from an outlet end; the water atomizer is connected with a water source for atomizing water.

* * * * *